United States Patent [19]

Christiano et al.

[11] 4,259,612

[45] Mar. 31, 1981

[54] FACEPLATE ASSEMBLY FOR A FLAT PANEL COLOR DISPLAY DEVICE

[75] Inventors: Victor Christiano, Hamilton Square; Charles B. Carroll, Trenton, both of N.J.

[73] Assignee: RCA Corporation, New York, N.Y.

[21] Appl. No.: 71,389

[22] Filed: Aug. 30, 1979

[51] Int. Cl.[3] ..... H01J 29/00; H01J 29/07; H01J 31/20

[52] U.S. Cl. ..... 313/422; 315/366

[58] Field of Search ..... 313/422; 315/366

[56] References Cited

U.S. PATENT DOCUMENTS

| | | | |
|---|---|---|---|
| 3,735,179 | 5/1973 | Kaplan | 313/408 |
| 4,145,633 | 3/1979 | Peters et al. | 313/422 X |

*Primary Examiner*—Robert Segal

*Attorney, Agent, or Firm*—Eugene M. Whitacre; Glenn H. Bruestle; Vincent J. Coughlin, Jr.

[57] ABSTRACT

A display device includes an evacuated envelope having a back wall and a plurality of mutually parallel internal support walls. Each of the support walls comprises a separable first and second wall member. Each of the first wall members has a proximal end in contact with the back wall. The support walls are substantially perpendicular to the back wall so that the support walls partition the device into a plurality of channels. A faceplate assembly integral with one surface of the envelope comprises in combination; a viewing faceplate, a mosaic screen, registration blocks disposed on the inner surface of the faceplate beyond the screen, a plurality of second wall members detachably attached to the registration blocks so that each of the second wall members extend between the distal end of a different one of the first wall members and the screen, and a plurality of discrete shadow masks slidably attached to and extending between adjacent ones of the second wall members. Each of the shadow masks extends along substantially the entire length of a different one of the channels.

25 Claims, 8 Drawing Figures

FACEPLATE ASSEMBLY FOR A FLAT PANEL COLOR DISPLAY DEVICE

BACKGROUND OF THE INVENTION

The present invention relates to a flat panel display device having an evacuated envelope with a plurality of internal support walls which extend from the back wall of the envelope to a mosaic screen on the faceplate and form a plurality of parallel channels, and particularly to a faceplate assembly for such a device.

U.S. Pat. No. 4,028,582 to Anderson et al., issued June 7, 1977, entitled "Guided Beam Flat Display Device," and now the subject of reissue application Ser. No. 862,188 filed Dec. 19, 1977, discloses a shadow mask extending across each of the channels and mounted on the internal support walls in spaced relation to the faceplate. Details of the shadow mask structure and how it is mounted on the support walls are not disclosed.

U.S. Pat. No. 4,145,633 to Peters et al. issued Mar. 20, 1979, entitled "Modular Guided Beam Flat Display Device," discloses a shadow mask mounted on the internal support walls and held in place by metal tips which extend from the support walls to the faceplate. A drawback of the Peters et al. structure is the complex retaining structure required to maintain the shadow mask between the metal tips and the support walls.

In copending application of John A van Raalte, Ser. No. 033,966, filed Apr. 27, 1979, entitled "Modular Tube Shadow Mask Support System," assigned to the same assignee as the instant application, there is shown and described a type of flat panel display device having a plurality of internal support walls forming a plurality of channels with a shadow mask in each of the channels. Each of the masks are supported at two oppositely disposed edges by a suspension system disposed on the envelope beyond the screen area. The shadow masks are unrestricted by the support walls. The support system relies on spring biasing means connected to at least one edge of each of the masks, to keep the masks flat during device operation. The van Raalte application does not describe how the suspension system is referenced to the phosphor screen so that the support walls do not interfere with the image area when the device is assembled.

None of the above-identified references show or describe a faceplate structure including a mosaic screen, shadow masks, shadow mask support structure and internal support walls which permits inspection of the faceplate assembly to assure register between the internal support walls and non-imaging areas of the mosaic screen prior to evacuation of the display device.

U.S. Pat. No. 3,735,179 to Kaplan, issued May 22, 1973, entitled "Face Panel Assembly for Color Cathode-Ray Tube," discloses a plurality of indexing posts on the faceplate cooperating with a plurality of notches in the shadow mask to hold the shadow mask in compression. The notch-post structure orients the mask apertures relative to their assigned dot triad on the phosphor screen to prevent lateral displacement of the mask. The notch-post structure also firmly anchors the mask to the faceplate so that mask movement is limited essentially to a displacement along the beam path, i.e., toward the screen, when subjected to thermal expansion. The Kaplan patent does not disclose or suggest a structure which permits movement of the mask perpendicular to both the beam path and the direction of high frequency scan.

SUMMARY OF THE INVENTION

A display device includes an evacuated envelope having a back wall and a plurality of mutually parallel internal support walls. Each of the support walls comprises a separable first and second wall member. Each of the first wall members has a proximal end in contact with the back wall. The support walls are substantially perpendicular to the back wall so that the support walls partition the device into a plurality of channels. A faceplate assembly integral with one surface of the envelope comprises in combination; a viewing faceplate, a mosaic screen, registration blocks disposed on the inner surface of the faceplate beyond the screen, a plurality of second wall members detachably attached to the registration blocks so that each of the second wall members extend between the distal end of a different one of the first wall members and the screen, and a plurality of discrete shadow masks slidably attached to and extending between adjacent ones of said second wall members. Each of the shadow masks extend along substantially the entire length of a different one of the channels.

DETAILED DESCRIPTION OF THE PREFERRED EMBODIMENT

Figure 1:
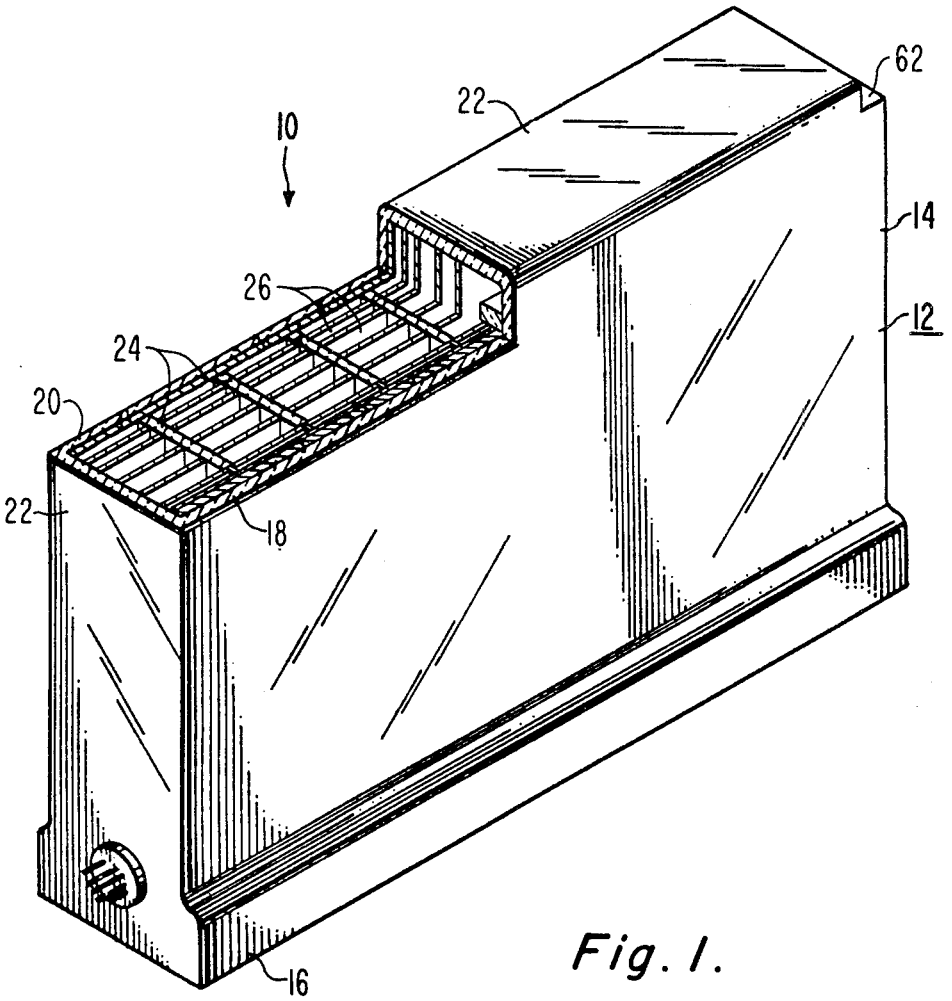
FIG. 1 is a perspective view partially broken away of a flat panel display device into which the present invention can be incorporated.

Referring to FIG. 1, one form of a flat display device of the present invention is generally designated as 10. The display device 10 comprises an evacuated envelope 12, typically of glass, having a display section 14 and an electron gun section 16. The display section 14 includes a rectangular, substantially flat front wall 18 which supports the viewing screen, and a rectangular substantially flat back wall 20 in spaced parallel relation to the front wall 18. The front wall 18 and back wall 20 are connected by side walls 22. The front wall 18 and back wall 20 are dimensioned to provide the size of the viewing screen desired, e.g., 75×100 cm, and are spaced apart about 2.5 to 10 cm. A plurality of internal support walls 24 extend between the front and back walls 18 and 20 and divide the envelope into a plurality of channels 26.

Figure 2:
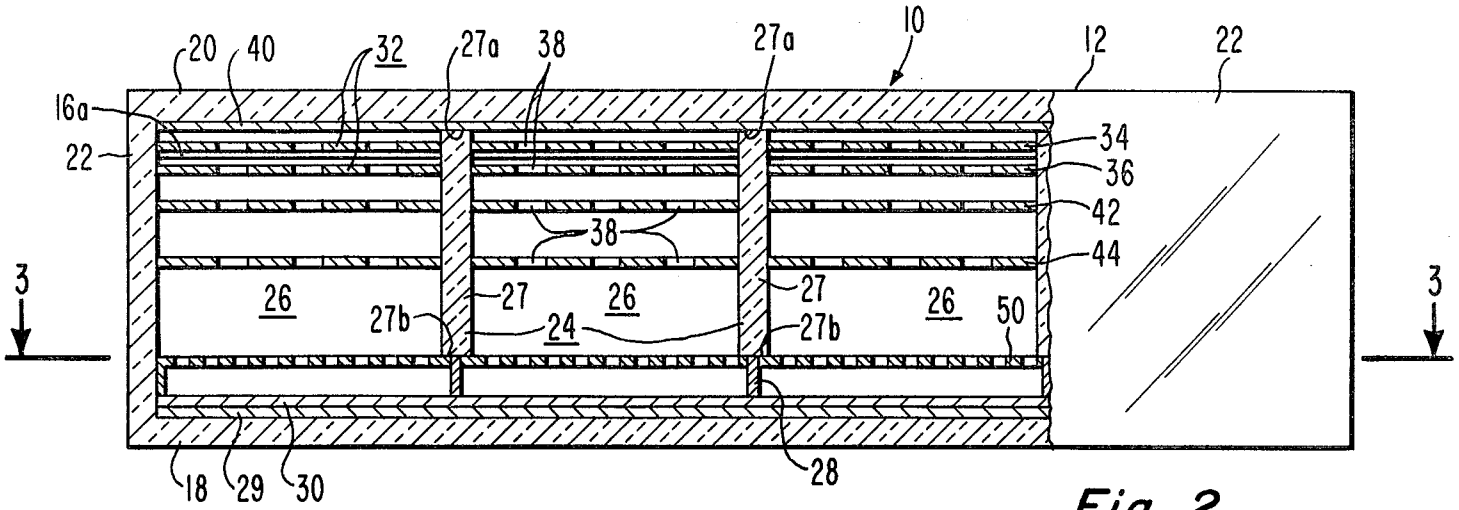
FIG. 2 is an enlarged, top plan view of the flat panel display device of FIG 1.

As shown in FIG. 2, each of the support walls 24 comprises a first wall member 27, preferably of glass, having a proximal end **27*a*** in contact with the back wall 20 and a distal end 27*b* in contact with a second wall member 28, hereafter referred to as a vane tip, which is separable from the first wall member 27.

On the inner surface of the front wall 18 is a mosaic phosphor screen 29. The phosphor screen 29 may be any well known type presently being used in color display tubes. Preferably, the screen 29 comprises three interlaced arrays of different color emitting phosphor lines separated by a light-absorbing matrix. A screen of this type is shown and described in the copending U.S. Pat. application Ser. No. 806,282 filed June 13, 1977, by John A van Raalte, entitled "Phosphor Screen for Modular Flat Panel Display Device," assigned to the assignee of the instant invention. A metal film electrode 30, partially transparent to electrons, is provided on the phosphor screen 29.

The gun section 16 is an extension of the display section 14 and extends along one end of the channels 26. The gun section may be of any shape suitable to enclose a particular gun structure contained therein. The electron gun structure contained in the gun section 16 may be of any well known construction suitable for generating three beams of electrons into each of the channels 26. For example, the gun structure may comprise a plurality of individual guns mounted at the ends of the channels 26 for directing separate beams of electrons into the channels. Alternatively, the gun structure may include a line cathode 16*a* extending along the gun section 16. The line cathode 16*a* extends across the ends of the channels 26 and is adapted to generate electrons which can be selectively directed as individual beams into the channels. A gun structure of the line type is described in U.S. Pat. No. 4,121,130 issued to R. A. Gange on Oct. 17, 1978 and entitled "Cathode Structure and Method of Operating the Same."

In each of the channels 26 is a beam guide 32 for focusing and periodically confining electrons into beams which travel in a path along the guide 32. The guide 32 includes a pair of elongated, spaced apart, parallel first and second guide grids 34 and 36 respectively, each having a plurality of apertures 38 therethrough. The apertures 38 are arranged so as to define a plurality of rows transversely across and columns longitudinally along the guide grids 34 and 36. A plurality of spaced, parallel conductors 40 are disposed on the inner surface of the back wall 20 and extend transversely across the channels 26. The conductors 40 are strips of an electrically conductive material, such as metal, coated on the back wall 20. Each of the conductors 40 lies directly opposite a transverse row of apertures 38 in the first guide grid 34. Means are provided for deflecting the beams out of the guide and toward the phosphor screen 29 at various points along the length of the channels 26.

In each of the channels 26 a focusing grid 42 may be located in spaced relation between the beam guide 32 and the metal film electrode 30 on the phosphor screen 29. An accelerating grid 44 may be interposed between the focusing grid 42 and the metal film electrode 30. The focusing grid 42 and the accelerating grid 44 also have a plurality of apertures 38 therethrough. Grids 42 and 44 serve as focusing and accelerating means, respectively, for the electron beams as the beams flow from the beam guide 32 to the phosphor screen 29. The operation of the beam guide as well as the focusing grid and accelerating grid structure of a flat panel display device is described in U.S. Pat. No. 4,028,582, issued June 7, 1977, incorporated by reference herein.

Figure 3:
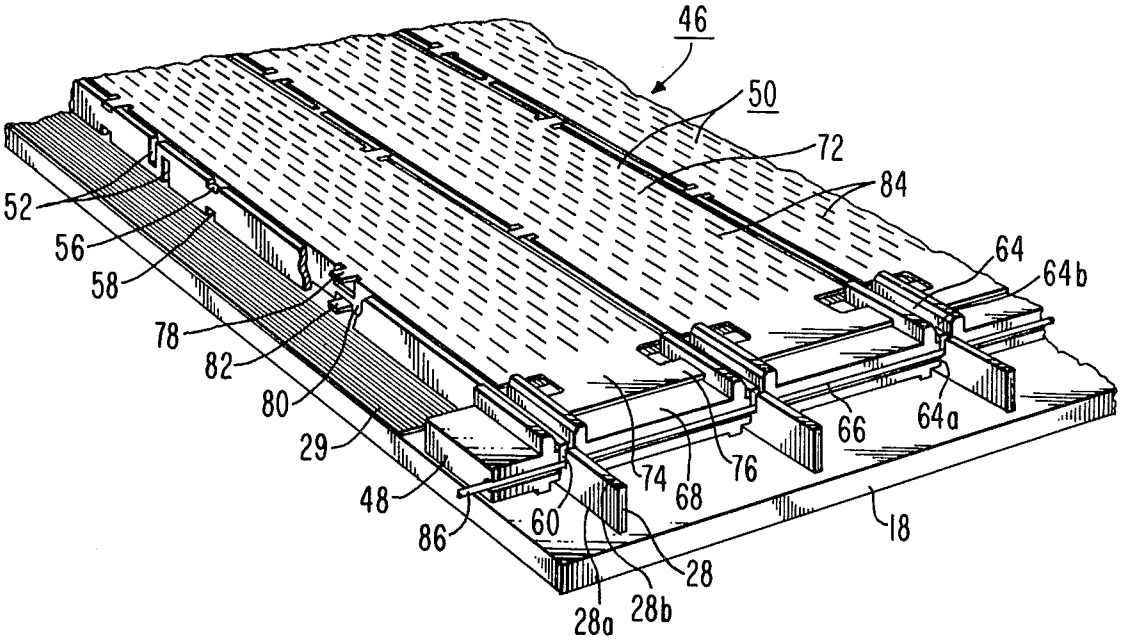
FIG. 3 is a partial perspective view of the faceplate assembly taken along line 3—3 of FIG. 2.

As shown in FIG. 3, a novel faceplate assembly 46 is integral with one surface of the envelope 12. The faceplate assembly 46 comprises the front wall 18 which serves as the viewing faceplate and a plurality of registration blocks 48 which are disposed on the inner surface of the faceplate in two mutually parallel rows (only one row shown) aligned parallel to the direction of high frequency scan. The phosphor screen 29 is disposed on the faceplate 18 between the rows of registration blocks 48. The faceplate assembly 46 further includes the vane tips 28 which are detachably attached to the registration blocks 48 so that a proximal end 28*a* of each of said vane tips contacts the screen 29. A plurality of discrete shadow masks 50 are slidably attached to, and extend between, the vane tips 28.

As shown in FIGS. 3–6, each of the vane tips 28 comprises a metal strip having a lateral dimension or thickness that is less than the lateral dimension of the first wall members 27 and a longitudinal dimension that is substantially equal to that of the first wall members. A plurality of expansion joints 52 are formed at longitudinally spaced intervals along the vane tips 28. Each of the expansion joints 52 is formed by two closely spaced expansion slots 54 extending transversely across the vane tips 28, one slot extending from the proximal end 28*a* of the vane tip and the other slot extending from a distal end 28*b*. The expansion joints 52 serve to permit longitudinal movement of the metal vane tips 28 which may result from the difference in the coefficient of thermal expansion of the metal tip 28 and the glass walls 18 and 27.

Each of the vane tips also include a plurality of locating tab slots 56 and locking tab slots 58 formed at longitudinally spaced intervals along the vane tips 28. Each of the locating tab slots 56 are formed by recesses extending transversely across the distal end 28*b* of the vane tip and the locking tab slots 58 are formed by recesses extending transversely across the proximal end 28*a* of the vane tip 28. The locating tab slots 56 and the locking tab slots 58 act in combination to position and secure the shadow masks 50 to the vane tips 28.

Each of the vane tips 28 further includes a keeper rod slot 60 (shown in FIG. 3) at each of the longitudinal ends (only one end shown) of the vane tips 28. Each keeper rod slot is formed by a recess extending transversely across the distal end 28*b* of the vane tips 28. The keeper rod slots 60 provide means to attach each longitudinal end of the vane tip 28 to the rows of registration blocks 48.

As shown in FIG. 1, the faceplate 18 of the faceplate assembly 46 has at least two precisely formed reference notches 62 at at least two corners of the faceplate (only one shown). These notches serve to accurately locate or reference the registration block 48 so that the blocks 48 are aligned parallel to the direction of high frequency scan. The reference notches 62 also align the faceplate assembly 46 of FIG. 3 with corresponding notches (not shown) in the back wall 20. The references notches 62 may be ground or otherwise formed in the faceplate 18 and the back wall 20. The references notches 62 provide more accurate alignment of tube elements than is otherwise provided by the edges of the faceplate 18 and the back wall 20.

Each of the rows of registration blocks 48 may comprise a single block integral with or attached to the faceplate 18 or, preferably a plurality of substantially identical, discrete blocks attached to the faceplate 18 by one or any number of means known to those skilled in the art. In either case, the coefficient of thermal expansion of the registration blocks 48 and any medium, e.g., nonvitreous glass frit, which may be used to attach the blocks 48 to the faceplate 18 should be substantially identical to that of the faceplate 18. The reference blocks 48 in the preferred embodiment may be made of glass.

As shown in FIG. 3, each of the rows of registration blocks 48 further includes a plurality of oppositely disposed support wall positioning grooves 64 formed in one exposed surface of the registration blocks 48. Each of the positioning grooves 64 has a step-like contour with the width or lateral dimension 64*a* of the positioning groove adjacent to the faceplate being sufficient to accommodate the vane tip 26 but being narrower than the portion 64*b* of the positioning groove remote from the faceplate 18 which has a width sufficient to accommodate the distal end 27*b* of one of the first wall members 27.

Each of the registration blocks 48 further includes a locking notch 66 formed in one of its exposed surfaces. The function of the locking notch 66 is described infra.

The distal ends 28*b* of the vane tips 28 extend above the vane tip positioning groove 64*a* so that they will be in intimate contact with the distal ends 27*b* of the first wall member 27 when the faceplate assembly 46 is assembled with the other display device component elements.

Each of the registration blocks 48 further includes at least one shadow mask registration groove 68 in one of the exposed surfaces, e.g., the distal surface of each of the blocks 48. If only one registration block is used in each of the rows, then a plurality of shadow mask registration grooves 68 are formed in each of the blocks. The registration grooves 68 in each of the rows of registration blocks 48 are oppositely disposed and accurately dimensioned in order to provide means for registering each of the shadow masks 50 with the phosphor screen 29. The registration grooves 68 are equally spaced along the registration blocks 48 and oriented perpendicularly to the direction of high frequency scan. The shadow mask registration grooves 68 are disposed between adjacent support wall positioning grooves 64.

In the faceplate assembly 46 wherein each of the parallel rows of registration blocks 48 comprises a plurality of discrete blocks, the blocks may be formed together, for example, by molding or machining so that the blocks are substantially indentical. Each of the discrete registration blocks 48 has a registration groove 68 in one of the exposed surfaces, a locking notch 66 in another, or the same, exposed surface and a portion of the step-like support wall positioning groove 64 at each end of each of the discrete registration blocks 48. The discrete registration blocks 48 are then disposed on the faceplate 18 in spaced apart relation so that the space between adjacent blocks provides the narrower lateral dimension of the support wall positioning groove 64*a* which accommodates the vane tip 26.

As shown in FIG. 3, the plurality of discrete shadow masks 50 are positioned adjacent to the faceplate 18 in spaced, parallel relation to the phosphor screen 29. The shadow masks 50 extend transversely across the channels 26 and along substantially the entire length of the channels. Each of the shadow masks 50 comprises a substantially flat apertured portion 72 between non-apertured end regions 74, each of which terminates in a pair of registration tabs 76. A plurality of locating tabs 78 extend from oppositely disposed edges of the apertured portion 72 of the shadow masks 50. The locating tabs 78 are coplanar with the apertured portion 72 but are disposed within the locating tab slots 56 of the vane tips 28 in such a manner that the locating tabs 78 from opposite edges of the masks are staggered. Each of the masks 50 has a substantially U-shaped cross-section comprising a pair of projections 80 which are substantially perpendicular to and extend longitudinally along the flat apertured portion 72 and form the sides of the U-shape of the shadow mask 50. A plurality of locking tabs 82 extend outwardly from the sides 80 of the shadow masks 50. The locking tabs 82 are aligned with and substantially parallel to the locating tabs 78. The locking tabs 78 are disposed within the locking tab slots 58 of the vane tips 28.

The shadow mask 50 is formed from a sheet of metal such as cold rolled steel and includes the apertured, active portion 72, having an array of elongated apertures 84 therein. The active portion is that portion which overlies the phosphor screen 29 and provides the shadowing or color selection function. For a phosphor screen 29 made up of spaced longitudinally extending strips, the apertures 84 are arranged in longitudinally extending vertical columns parallel to the phosphor strips. The column-to-column spacing between the apertures 84 is substantially equal across each of the channels 26.

Of principal concern in any embodiment having a vertical line screen 29 and a mask 50 having elongated apertures 84 is the prevention, or at least minimization, of the effective horizontal motion of the mask. Such motion can be caused by thermal expansion of the mask 50 in the horizontal direction, that is, the direction of high frequency scan. Motion of the mask in the vertical or longitudinal direction is of little consequence since the mask apertures 84 and the phosphor strips on the line screen 29 will still remain aligned. In the preferred embodiment shown in FIG. 3, the minimization of the effective horizontal motion of the mask 50 is achieved by fabricating a plurality of discrete, indentical masks. Each of the masks 50 spans one of the channels 26. For example, if each of the channels 26 has a horizontal dimension of about 2.5 cm, the thermal expansion of each of the masks 50 in the horizontal dimension is negligible for all operating conditions of the display device and horizontal register between the mask apertures 84 and the phosphor strips on the line screen 29 is assured.

Figure 4:
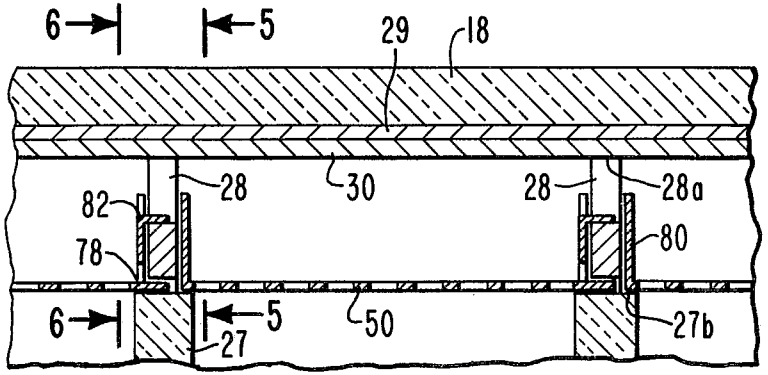
FIG. 4 is an enlarged view, transversely across a portion of one of the channels of the display device of FIG. 2.
Figure 5:
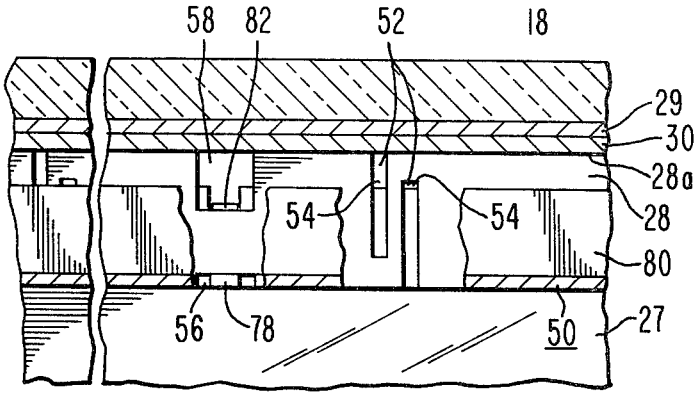
FIG. 5 is a sectional view, partially broken away, longitudinally along a portion of one of the channels taken along line 5—5 of FIG. 4.
Figure 6:
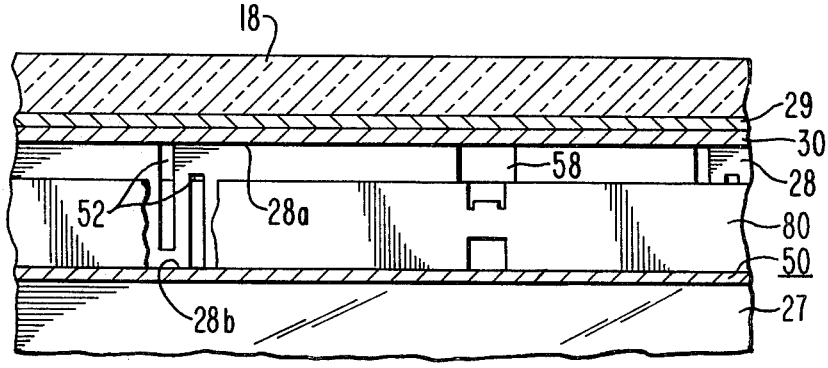
FIG. 6 is a sectional view longitudinally along a portion of one of the channels taken along line 6—6 of FIG. 4.

Interconnection between the masks 50 and the front wall 18 is made by means of the novel faceplate assembly 46. As shown in FIG. 3, each of the vane tips 28 may be disposed in a different one of the vane tip positioning grooves 64*a* within the registration blocks 48 by means of a pair of keeper rods 86 (only one is shown) which extend through the keeper rod slots 60 of the vane tips. The keeper rods 86 engage the locking notches 66 in one surface of each of the rows of registration blocks 48 and secure or lock the vane tips 28 to the registration blocks. Each of the vane tips 28 contact a different one of the strips of non-luminous material of the black matrix screen 29 on the faceplate 18. The vane tips 28 are oriented within the vane tip positioning grooves 64*a* so that the vane tips 28 are mutually parallel and the locking tab slots 58, recessed in the proximal end 28*a* of the vane tips 28, are adjacent to the non-luminous strips on screen 29. The shadow masks 50 are aligned with and attached to the vane tips 28 by means of the locating tabs 78 and the locking tabs 82 on the masks 50 which register with and engage the locating tab slots 56 and the locking tab slots 58, respectively, of the vane tips 28. As shown in FIGS. 4 and 5, the locking tabs 82 extend into the locking tab slots 58 to secure the shadow masks 50 to the vane tips 28. The longitudinal dimension of the locating tab slots 56 and the locking tab slots 58 is greater than the longitudinal dimension of the locating tabs 78 and the locking tabs 82 to permit thermal expansion of the mask 50 in the longitudinal direction, i.e., perpendicular to the direction of high frequency scan, during all operating conditions. Horizontal register between the shadow mask apertures 84 and the phosphor screen 29 is maintained by means of the registration tabs 76 which slidably contact the registration grooves 68 in the distal surface of registration blocks 48. The registration grooves 68 limit the lateral or horizontal displacement of the shadow mask registration tabs 76 while allowing the masks 50 to move freely in the longitudinal direction. The lateral stability provided by the registration tabs 76 and the registration grooves 68 also insure that the vane tips 28, secured to the shadow masks 50 as described above, remained aligned with the strips of non-luminous material of phosphor screen 29 disposed on the faceplate 18.

The perpendicular spacing between the shadow masks 50 and the screen 29, which is generally known as the "q" spacing, may be accurately maintained by requiring that the spacing between the bottom of the vane tip locating tab slots 56 and the faceplate 18 be substantially equal and dimensioned to provide the desired "q" spacing. It has also been determined that the depth of the locating tab slots 56 should be slightly greater than the thickness of the shadow mask locating tabs 78 so that the shadow masks 50 will not be pinched between the distal end **28*b* of the vane tips 28 and the distal end 27*b* of the first wall member 27 during thermal expansion of the device elements. To insure that the "q" spacing remains fixed regardless of faceplate orientation, it is also desirable that the shadow mask locking tabs 82 engage the vane tip locking tab slots 58 so as to provide a tension to retain the locating tabs 78 within the locating tab slots 56**.

The above described faceplate assembly 46 may be inspected before being sealed to the connecting sidewalls 22 to insure that the vane tips 28 are aligned with the black matrix strips of the phosphor screen 29 and do not obstruct the color emitting phosphor lines of the screen. If misalignment of the vane tips 28 occurs, the faceplate assembly 46 may be disassembled by removing the keeper rods 86 from the locking notches 66 in the registration blocks 48. Reassembly of the faceplate assembly 46 can be effected by repeating the procedures outlined above.

Figure 8:
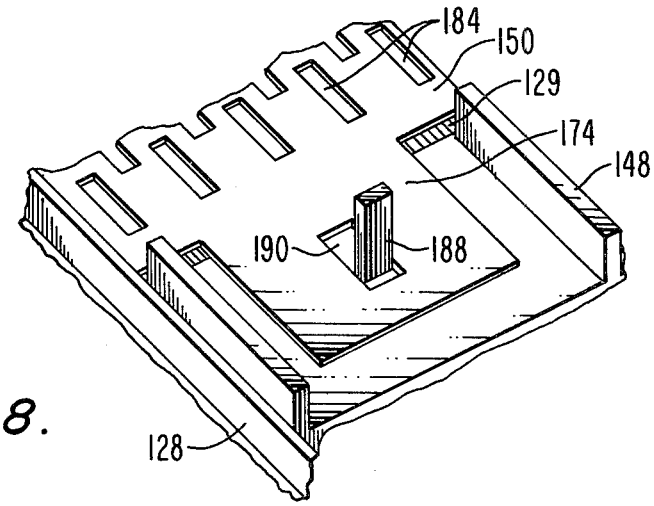
FIG. 8 is an enlarged view of the portion of the display device within the circle 8 in FIG. 7.
Figure 7:
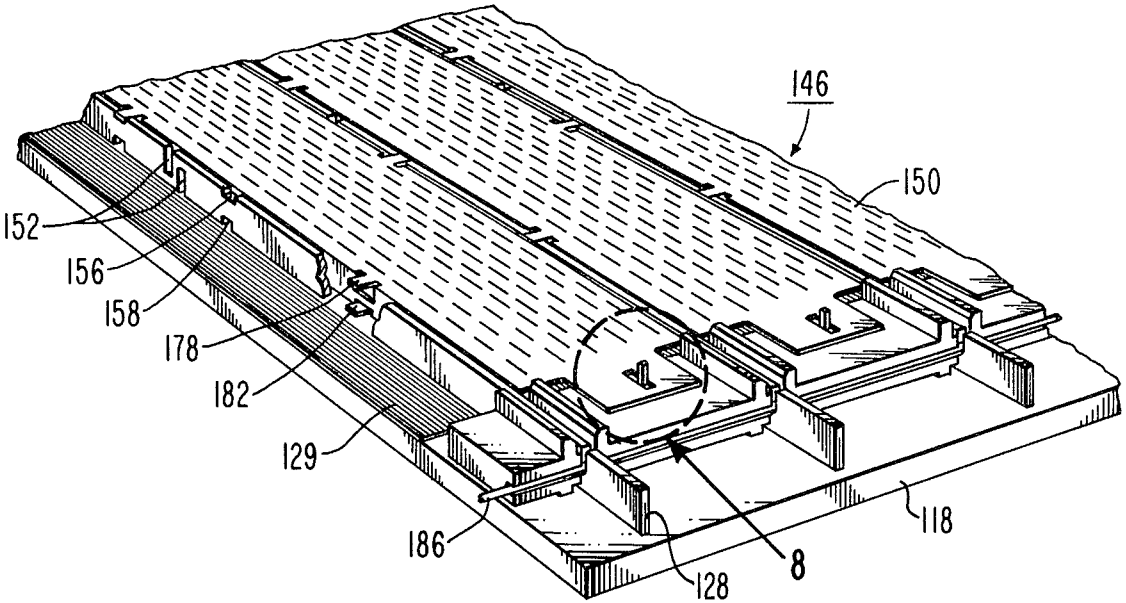
FIG. 7 is a partial perspective view of another embodiment of the faceplate assembly.

A second embodiment of the faceplate assembly, generally designated 146 is shown in FIGS. 7 and 8. The structural elements of faceplate assembly 146 are identical to the simularly enumerated elements of faceplate assembly 46 shown in FIG. 3, except that the first digit of each number is increased by one hundred to identify the embodiment. The registration blocks 148 include alignment posts 188 either integral with or attached to the distal surface of the registration blocks 148. The shadow masks 150 include alignment slots 190 in the non-apertured end regions 174 of the shadow masks 150. The alignment posts 188 and the alignment slots 190 are dimensioned to permit the shadow masks 150 to move freely in the longitudinal direction but to restrict the movement of the masks 150 in the lateral direction so as to maintain register between the shadow mask apertures 184 and the phosphor lines screen 129.

While the alignment posts 188 are shown as rectangular members, it is clear that the shape of the post may be freely varied and may, e.g., be triangular, round or any shape which will permit mask movement in the longitudinal direction while restricting mask movement in the lateral direction.

We claim:

1. In a display device, having an evacuated envelope including a back wall, a plurality of mutually parallel internal support walls, each of said support walls comprising separable first and second wall members, each of said first wall members having a proximal end in contact with said back wall and a distal end in contact with a second wall member, said support walls being substantially perpendicular to said back wall so that said support walls partition the device into a plurality of channels, the improvement comprising:

a faceplate assembly integral with one surface of said envelope comprising in combination;

a viewing faceplate having reference means therein;

at least two registration blocks disposed in mutually parallel rows on the inner surface of said faceplate, each of said registration blocks being aligned parallel to the direction of high frequency scan, each of said blocks having block registration means therein;

a mosaic phosphor screen on said inner surface of said faceplate between said parallel rows of registration blocks;

means for detachably attaching said plurality of second wall members to said registration blocks so that a proximal end of each of said second wall members contacts said phosphor screen, each of said second wall members having a distal end in contact with the distal end of a different one of said first wall members; and a plurality of discrete shadow masks in spaced relation to said phosphor screen, each of said shadow masks being slidably attached to and extending between adjacent ones of said second wall members, each of said shadow masks having mask registration means connected to said block registration means, each of said shadow masks extending along substantially the entire length of a different one of said channels.

2. A display device as described in claim 1 wherein said second wall members are metal strips comprising vane tips, each of said vane tips having a lateral dimension that is less than the lateral dimension of said first wall members, each of said vane tips having a plurality of expansion joints at longitudinally spaced intervals along said distal end and said proximal end.

3. A display device as described in claim 2 wherein each of said vane tips has a plurality of locking tab slots and locking tab slots in said oppositely disposed distal and proximal ends respectively, said slots being located at longitudinally spaced intervals therealong.

4. A display device as described in claim 1 wherein said reference means comprises reference notches at at least two corners of said viewing faceplate.

5. A display device as described in claim 1 wherein said registration blocks have a coefficient of thermal expansion substantially identical as that of the viewing faceplate.

6. A display device as described in claim 1 wherein said block registration means includes a plurality of registration grooves in one of the exposed surfaces of said registration blocks.

7. A display device as described in claim 1 wherein said block registration means includes a plurality of alignment posts integral with or attached to an exposed surface of said registration blocks.

8. A display device as described in claim 6 wherein said registration grooves are equally spaced along but perpendicular to the direction of high frequency scan.

9. A display device as described in claim 1 wherein each of said rows of said registration blocks comprises a plurality of oppositely disposed equally spaced support wall positioning grooves, said support wall positioning grooves being interleaved with said block registration means.

10. A display device as described in claim 9 wherein each of said support wall positioning grooves has a step-like contour comprising a vane tip positioning groove and a first wall member positioning groove with the lateral dimension of the vane tip positioning groove adjacent to the faceplate being narrower than the lateral dimension of the first wall member positioning groove remote from the faceplate.

11. A display device as described in claim 1 wherein each of said rows of said registration blocks comprises a plurality of discrete blocks disposed in spaced apart relation so that the space between adjacent blocks provides the lateral dimension of the support wall positioning groove.

12. A display device as described in claim 10 wherein said phosphor screen comprises a black matrix line screen, said matrix further comprising strips of non-luminous material.

13. A display device as described in claim 12 wherein said strips of non-luminous material are disposed on said faceplate in alignment with said vane tip positioning grooves.

14. A display device as described in claim 13 wherein each of said vane tips is disposed in a different one of said vane tip positioning grooves so that each of said vane tips contacts a different one of said strips of non-luminous material disposed on said faceplate, said vane tips being oriented within said vane-tip positioning grooves so that said locking tab slots are adjacent to said strips of non-luminous material.

15. A display device as described in claim 14 wherein said vane tips are mutually parallel, said vane tips being equally spaced along and perpendicular to the direction of high frequency scan.

16. A display device as described in claim 1 wherein said means for detachably attaching said second wall members to said registration blocks comprises locking means.

17. A display device as described in claim 16 wherein said locking means includes at least two keeper rods in combination with a pair of keeper rod slots in each of said second wall members and a locking notch in one surface of each of said registration blocks.

18. A display device as described in claim 1 wherein each of said shadow masks has a U-shaped cross section comprising a substantially flat portion having non-apertured end regions with an apertured portion between said end regions, said apertured portion extending between the adjacent vane tips and providing the color selection function, and a pair of substantially perpendicular projections forming the sides of the shadow mask extending longitudinally along the apertured portion of each of the masks.

19. A display device as described in claim 18 wherein said non-apertured end regions of said shadow masks comprise mask registrating means, said mask registration means being slidably connected to said block registration means so as to limit lateral displacement of said shadow masks and assure both horizontal register between said apertured portion of said shadow mask and said phosphor strips and alignment of said vane tips with the strips of non-luminous material disposed on the faceplate.

20. A display device as described in claim 19 wherein said mask registration means include registration tabs and said block registration means includes registration grooves.

21. A display device a described in claim 19 wherein said mask registration means include alignment slots and said block registration means includes alignment posts.

22. A display device as described in claim 18 wherein each of said shadow masks includes securing means for slidably attaching said masks to said adjacent vane tips.

23. A display device as described in claim 22 wherein said securing means includes a plurality of locating tabs extending from oppositely disposed edges of the apertured portion of said shadow mask, said locating tabs being coplanar with said apertured portion, and a plurality of locking tabs extending outwardly from said sides of said shadow mask, said locking tabs being parallel to said locating tabs.

24. A display device as described in claim 23 wherein said locating tabs of said shadow mask are disposed within said locating tab slots of said vane tips and said locking tabs are disposed within said locking tab slots of said vane tips so that the desired spacing between the apertured portion of said shadow masks and the screen is assured.

25. A display device as described in claim 24 wherein said locating tabs and said locking tabs are free to slide within said vane tip locating and locking slots, respectively, in a direction perpendicular to the direction of high frequency scan so as to maintain vertical register between said apertured portion of said shadow mask and said line screen during thermal expansion of said shadow mask.

* * * * *